United States Patent [19]

Hajto et al.

[11] Patent Number: 5,041,177

[45] Date of Patent: Aug. 20, 1991

[54] AMMONIUM NITRATE/FUEL OIL BLASTING EXPLOSIVE HAVING DECREASED OIL SEGREGATION

[75] Inventors: Ernest A. Hajto; Christopher J. Preston; Earl D. Reckzin, all of North Bay, Canada

[73] Assignee: ETI Explosives, Toronto, Canada

[21] Appl. No.: 520,020

[22] Filed: May 7, 1990

[51] Int. Cl.[5] ..... C06B 45/30

[52] U.S. Cl. ..... 149/5; 149/2; 149/21; 149/46; 149/60; 149/109.6

[58] Field of Search ..... 149/2, 21, 46, 5, 60, 149/109.6

[56] References Cited

U.S. PATENT DOCUMENTS

| | | | |
|---|---|---|---|
| 2,537,039 | 1/1951 | Downard | 149/48 |
| 3,279,965 | 10/1966 | Brancion | 149/46 |
| 3,540,953 | 11/1970 | Schulze et al. | 149/2 |
| 4,736,683 | 4/1988 | Bachmann et al. | 149/60 |

*Primary Examiner*—Stephen J. Lechert, Jr.

*Attorney, Agent, or Firm*—Rogers, Bereskin & Parr

[57] ABSTRACT

An explosive composition comprising an explosive mixture of ammonium nitrate and fuel oil. The fuel oil is selected to provide an oil separation sufficiently low so that the explosive is detonatable. The fuel oil is also selected such that the viscosity of the explosive is sufficiently low so that the explosive may be loadable into a borehole. The explosive is substantially free of tackifying agents.

56 Claims, No Drawings

AMMONIUM NITRATE/FUEL OIL BLASTING EXPLOSIVE HAVING DECREASED OIL SEGREGATION

This invention relates to the field of explosive compositions comprising ammonium nitrate and fuel oil (ANFO). More particularly, this invention relates to an ANFO explosive composition which does not require the addition of agents to prevent segregation of the fuel oil from the ammonium nitrate.

Explosive compositions containing ammonium nitrate have been widely used throughout the world for many years. As ammonium nitrate is not readily detonatable in and of itself, it is typically mixed with carbonaceous fuels in order to obtain a mixture which is more or less oxygen balanced and therefore detonatable. Additional compounds such as sensitizers, densifiers, modifiers and surfactants may also be added to an ANFO explosive composition to improve various properties of the explosive composition including the sensitivity to detonation of the explosive, the energy of the explosion and the flowability of the explosive composition.

Typically, explosive compositions containing ammonium nitrate are manufactured at the location where they are to be utilized. For example, an ANFO explosive composition could be prepared at a mine and immediately loaded into a series of boreholes. The ANFO explosive composition would be loaded into the boreholes (typically from about 10 to 15 holes to more than about 100 holes) over a period of days. Typically, an ANFO explosive composition may be kept in a borehole anywhere from 1 hour up to 14 days prior to being detonated. If the explosive is a prepackaged explosive composition, then due to shipping and handling time, the explosive composition must be stable for extended periods of time. In some cases, the length of time between mixing the explosive composition and detonation of the explosive composition may be up to 90 days.

A problem which has been encountered with prior ANFO explosive compositions is that the fuel oil tends to separate from the ammonium nitrate during the time that the explosive composition is stored in the borehole awaiting detonation. The longer the storage time, the greater the oil separation. If the oil separates from the ammonium nitrate, then the explosive composition may deflagrate or it may fail to explode.

In the past, various approaches have been taken to solve this fuel drainage problem. These approaches include attempts to modify the structure of the ammonium nitrate or the addition of various additives to either the fuel oil or the mixture to improve the retention of fuel oil on the ammonium nitrate particles. By way of example of the former approach, U.S. Pat. No. 3,279,965 relates to a new form of ammonium nitrate which has an especially porous, foam-like structure with a high power of adsorption. The porous, foam-like ammonium nitrate is prepared by evaporating a thin layer of a concentrated aqueous solution of ammonium nitrate in a crystallizer at reduced pressure. U.S. Pat. No. 3,540,953 describes conventional ANFO explosive compositions which employ low density ammonium nitrate prills which have a particle density of up to about 1.45. According to the disclosure, previous attempts to use high density ammonium nitrate prills in explosive compositions have centred about physical modification of the dense prills by roll-crushing, grinding, comminuting, water etching and the like to improve their oil retention.

In contrapoint, U.S. Pat. No. 3,540,953 proceeds to utilize the latter approach, namely the use of additives. U.S. Pat. No. 3,540,953 relates to an explosive containing ammonium nitrate prills which have a particle density of at least 1.5 and are hard, smooth and relatively non-porous. The explosive comprises a mixture of the high density prills, a carbon black and a liquid hydrocarbonaceous fuel. It is provided in the patent that previous attempts to use high density ammonium nitrate prills in explosive compositions have not been successful because the prill's surface militated against the requisite intimate contact between the ammonium nitrate and the other constituents of the explosive mixtures. Accordingly, a carbon black in the amount of from about 4 percent to about 10 percent by weight of the ammonium nitrate was added to the explosive mixture.

By way of further example of the latter approach, various patents have disclosed the use of various tackifying agents to increase the retention of the fuel oil on ammonium nitrate. Tackifying agents are known in the art and include polymers and macromolecules. The polymer is typically soluble in the fuel oil and nonreactive with the ammonium nitrate. For example, U.S. Pat. No. 2,537,039 is directed towards a gelatinous explosive compositions, which include ammonia dynamites, with various tackifying agents such as polyisobutylene (mw 80,000). U.S. Pat. No. 4,736,683 teaches the use of a high molecular weight polymer having a high stringiness factor as the tackifying agent.

All of the forgoing products involve complicated manufacturing steps, or do not sufficiently solve the oil drainage problem or involve the use of expensive additives such as a polymer.

What is desired is an ANFO explosive composition having improved oil retention properties. It is also desired to provide an ANFO explosive composition which does not involve the use of complicated manufacturing steps or the use of expensive additives.

According to the present invention, improved ammonium nitrate blasting explosive compositions are provided which comprise an explosive mixture of low adsorption ammonium nitrate particles and fuel oil wherein the fuel oil is selected such that the explosive composition has an oil segregation factor sufficiently low so that the explosive composition is detonatable and that the explosive composition is loadable into a borehole and wherein the explosive composition contains substantially no tackifying agents. According to a preferred embodiment, the ammonium nitrate is present in the form of high density mini prills and the oil separation is less than about 2 percent.

In order to provide a low oil separation factor, the fuel oil is selected according to its viscosity at 40° C. as measured by ASTM D-445. The fuel oil may be selected from naphthenic and paraffinic oils. In the case of paraffinic oils, it is preferred that the viscosity of the oil at 40° C. as measured by ASTM D-445 is greater than about 33 cSt. With respect to naphthenic oils, the viscosity is preferably above about 20 cSt. The maximum viscosity is determined by the ability to load the explosive into a borehole. The maximum viscosity will vary depending upon a number of factors including the loading temperature, the surfactants and coatings which are added to the explosive composition and the loading equipment. Preferably, the viscosity of the fuel is below about 400 cSt and, more preferably, below about 100 cSt.

Various additives may be added to the explosive composition to improve sensitivity, density, flowability, stability and energy. These additives include microspheres, metal fuels, water blocking agents, aerating agents and densifiers.

These explosive compositions are storage stable. By this we mean that they are capable of being stored, once mixed, for up to 90 days or more and thereafter still be detonatable. These explosive compositions are simple to manufacture as they do not require any modification or treatment of the ammonium nitrate prills. Further, the use of expensive additives such as polyisobutylene polymers and macromolecules is not required.

These and other advantages of the instant invention may be understood by the following description of a preferred embodiment of the invention.

The explosive compositions of the present invention comprise an explosive mixture of ammonium nitrate and fuel oil. The explosive composition used in the present invention contains sufficient fuel oil so that the explosive composition is essentially oxygen-balanced, taking into consideration the total oxidizing salts, fuel oil, sensitizers, and other additives present in the explosive. "Essentially oxygen-balanced" means the blend has an oxygen balance more positive than about minus 25 percent and, preferably, in the range of about minus 10 to plus 10 percent. If the ANFO explosive composition is to be used by itself, then the ANFO must be essentially oxygen-balanced. However, if an emulsion or other explosive agent is mixed with the ANFO, then the final mixed explosive composition is essentially oxygen-balanced.

It is preferred that the fuel oil is present in an amount from about 2 to about 10 weight percent based upon the weight of the ammonium nitrate and the fuel oil. More preferably, the fuel oil is present in an amount from about 4 to about 8 weight percent and most preferably, the ratio of ammonium nitrate to fuel oil is about 94:6.

Particulate ammonium nitrates suitable for use in ANFO blasting explosives are known in the art. The particulate ammonium nitrates which may be used pursuant to this invention are even those which, in conventional ANFO explosive compositions, would produce an ANFO explosive composition having unacceptable levels of oil segregation. Such particles have a low power of oil adsorption and/or a low power of oil absorption. The factors which affect the oil adsorption of particulate ammonium nitrate include the porosity of the ammonium nitrate, the coating, if any, on the ammonium nitrate and the surface area of the ammonium nitrate particle. As the porosity and the surface area of ammonium nitrate particles decrease, the absorbability of the particles decreases. Further, coatings such as magnesium stearate tend to decrease the absorbability of the ammonium nitrate particles. Thus even ammonium nitrate particles having a high porosity may benefit from this invention if the particles have been coated. While various factors may alter the porosity of ammonium nitrate particles, for ease of reference, those particles discussed above which may be used pursuant to this invention are hereinafter referred to as "low adsorption ammonium nitrate particles". Exemplary of such particles are high density mini prills. It is surprising that a storage stable ANFO explosive composition may be prepared using high density mini prills without the need for tackifiers or modification of the structure of the mini prills.

Suitable low adsorption ammonium nitrate particles may be in the form of separate discrete particles such as prills, granules, pellets and fines. Suitable low porosity ammonium nitrate particles which may be utilized in the explosives of this invention are taught in U.S. Pat. No. 4,736,683.

Preferably, the low adsorption ammonium nitrate particles substantially comprise high density prills such as mini prills. The untamped bulk density of the high density ammonium nitrate prills is generally from about 0.85 to about 1.00 g/cc and, preferably, from about 0.90 to about 1.00 g/cc, and, most preferably, about 0.95 g/cc, as determined by weighing an untamped sample of the prills in a container of known volume.

A portion of the ammonium nitrate component may be replaced by other inorganic oxidizer salts known in the art including alkali metal nitrates and perchlorates (such as sodium nitrate and potassium nitrate) or alkaline-earth metal nitrates and perchlorates (such as calcium, magnesium and barium nitrates). These additional components will generally be added in amounts from about 0 to about 20 weight percent and, more preferably, from about 0 to about 15 weight percent based upon the weight of the ammonium nitrate. It is to be appreciated that the additional inorganic oxidize salt may have a higher power of adsorption for oil. In this case, then the oil drainage problem may be reduced in severity. This is a factor which is to be taken into account when selecting a suitable oil pursuant to this invention.

It is preferred that the ammonium nitrate is coated with an anti-caking agent. Ammonium nitrate coatings are known in the art. The ammonium nitrate may be coated with a conventional anti-caking agent such as clay (for example, bentonite), talc or metallic salts of aliphatic monocarboxylic acids of 6 to 24 carbon atoms. The metallic component of the salt may be alkali or alkaline-earth metals such as sodium, zinc, copper, magnesium, potassium, calcium, barium or strontium. The fatty acid may be hexanoic acid, heptanoic acid, caprylic acid, capric acid, lauric acid, myristic acid, palmitic acid, stearic acid, oleic acid or tallic acid or the like. Preferably, the coating is magnesium stearate or a mixture of magnesium stearate and magnesium oxide.

The amount of anti-caking agent which may be used is preferably from about 0.1 to about 1 weight percent and, more preferably, from about 0.1 to about 0.2 weight percent based on the weight of the inorganic oxidizer salt which is to be coated. When the coating is a metallic salt of a fatty acid, such as magnesium stearate, then lesser amounts of the anti-caking agent are utilized.

As discussed above, the ammonium nitrate used pursuant to this invention may be low adsorption ammonium nitrate particles or ammonium nitrate particles which have a high degree of oil adsorption (due for example to the porosity of the particles) which are subsequently coated with an anti-caking agent. Once such latter particles are coated with an anti-caking agent, they may become low adsorption ammonium nitrate particles and benefit from the invention.

The fuel oil used in the explosive compositions of the present invention is selected such that the explosive composition has an oil settlement factor sufficiently low so that (1) the explosive is detonatable after storage for the required time at the ambient temperature, and, (2) the explosive is loadable into a borehole.

Oil settlement is measured by mixing 94 weight percent of ammonium nitrate with 6 weight percent of the fuel oil based on the weight of the total composition which is to be tested. Prior to mixing, 3 drops of red-orange dye are added to the test oil. The ammonium nitrate and fuel oil are mixed and poured into a 5 liter stainless steel container. Using a wood or plastic stirrer, the ingredients are mixed until a uniform coloration is achieved throughout the composition. Typically, if manual mixing is utilized, this takes approximately 5 minutes of mixing. This composition is poured into a 500 cc graduated plastic cylinder. The mixture is added to the cylinder so as to cause the composition to completely fill the entire volume of the cylinder. When the cylinder is full, an airtight plastic seal is placed on the top of the cylinder to prevent oxidation or evaporation of the oil.

The cylinder is then placed in a constant temperature storage facility and allowed to stand for one week. After one week of storage at a constant temperature, the plastic seal is broken and a 20 gram sample is taken from the top of the cylinder. A second 20 gram sample is taken from the bottom of the cylinder. The samples are analyzed for oil content using ether extraction (ASTM A-4224). The oil settlement is determined by taking the difference between the percent oil content of the bottom sample and the percent oil content of the top sample.

Preferably, the oil settlement (o.s.) is less than about 2% and, more preferably, less than 1% and, most preferably less than about 0.5% at the temperature at which the explosive will be stored.

An explosive composition having low oil settlement is obtained by selecting an oil which is sufficiently viscous so as not to separate from the low adsorption ammonium nitrate particles during storage. The factors which affect the selection of the oil include the temperature at which the explosive is stored, the length of time during which the explosive will be stored prior to detonation, the classification of the crude (e.g. paraffinic or naphthenic) and the viscosity of the fuel oil. As the storage temperature of the explosive increases, and/or the storage time of the explosive increases, a more viscous fuel oil will be required. Most surprisingly, it has been found that the nature of the crude oil plays an important role in the required viscosity. Additional factors which will also affect the selection of the oil include the porosity, coating (if any) and surface area of the ammonium nitrate. If the porosity and surface area of the ammonium nitrate are increased, or if the ammonium nitrate is not coated, then the adsorption of oil on the prill is increased and a less viscous oil is required to obtain the same degree of stability of the explosive composition. However, if one or more of these factors is reversed, then a more viscous oil would be required.

The oil which is selected should not be so viscous that the ammonium nitrate can not be properly mixed with fuel oil to form an ANFO or ANFO blend explosive composition or so that the resultant ANFO explosive composition can not be loaded into a borehole. While the upper limit of the viscosity of the oil which may be utilized may be raised, for example, by heating the ANFO, for general purposes, the viscosity of the oil is preferably below about 400 cSt and, more preferably, below about 100 cSt. Surprisingly, by switching from a paraffinic oil to a naphthenic oil, an oil having a lower viscosity may be utilized to obtain an ANFO explosive composition having the same degree of oil separation.

More particularly as mentioned hereinbefore, it has been found that, in the case of an explosive composition which includes a paraffinic oil as the fuel source and which is to be stable at about 20° C. for about one week, the viscosity of the fuel oil, as measured by ASTM D-445 at 40° C. is preferably more than about 33 cSt and, more preferably above about 35 cSt. If the explosive composition will be stored for about 2 to 3 weeks, then the viscosity of the oil is preferably greater than about 45 cSt. However, in the case of a naphthenic oil, it is preferred that the viscosity is above about 20 cSt and, more preferably, about 25 cSt if the explosive composition is to be stored for about one week. If the explosive composition will be stored for 2 to 3 weeks before detonation, then preferably the viscosity of the oil is greater than about 30 cSt. It is surprising that a stable explosive may be obtained using particulate ammonium nitrate and fuel oil without a tackifier and without modifying the physical characteristics of the ammonium nitrate prills. Further, it is surprising that such stable compounds may be obtained using a naphthenic oil which has a viscosity of 20 cSt (as measured by ASTM D-445 at 40° C.) while a paraffinic oil having the same viscosity may not be suitable under identical conditions of storage.

Higher viscosities are preferred when the ANFO is stored in surface vessels in extremely hot climates or when the ANFO is to be packaged and stored in hot magazines for extended periods of time. For example, in the case of an ANFO which includes a paraffinic oil as the fuel source and which is to be stable at about 30° C. for about one week, the viscosity of the fuel oil, as measured by ASTM D-445 at 40° C., is preferably more than about 40 cSt. If the explosive composition will be stored for about 2 to 3 weeks, then the viscosity of the oil is preferably greater than about 50 cSt. In a similar case where the fuel oil source is naphthenic oil, then, the viscosity is preferably more than 25 cSt (if the ANFO is to be stable for about one week) and preferably more than about 35 cSt (if the ANFO is to be stable for about 2 to 3 weeks).

In colder climates, such as that of Canada in the winter, the temperature of boreholes (once surface effects are discounted) is generally in the range of 5° C. If an ANFO explosive composition is mixed at ambient temperatures and loaded directly into a borehole, then, when the fuel oil source is a paraffinic oil, the viscosity of the fuel oil is preferably more than about 10–15 cSt (if the ANFO is to be stable for about one week) and more than about 12.5–17.5 cSt (if the ANFO is to be stable for about 2–3 weeks). In the case of naphthenic oil, then the viscosity is preferably more than about 10 cSt (if the ANFO is to be stable for about one week) and more than about 15 cSt (if the ANFO is to be stable for about 2–3 weeks).

As discussed above, the viscosity and fuel oil source for the ANFO explosive composition are selected to provide the required decrease in oil separation. Generally speaking, the higher the viscosity of the fuel, the better the fuel retention. However, in order to ensure uniform distribution of the fuel covering the prill, the lower end of the available viscosity range is preferred, especially in small borehole diameter applications (eg. 2"or less).

If a paraffinic oil is not available having the requisite degree of viscosity, then different paraffinic oils may be mixed together to obtain an oil having the requisite viscosity. Similarly, naphthenic oils may be mixed to obtain a specified viscosity. Naphthenic and paraffinic oils are also capable of being mixed to obtain an oil having the requisite degree of viscosity. In these cases, due to the presence of naphthenic oil, a lesser viscosity would be required than if only paraffinic oils were utilized.

In some applications, a naphthenic or paraffinic oil may be mixed with other oils which are conventionally used to prepare ANFO explosive compositions. The napthenic or paraffinic oil may, in such cases, be blended with any oil conventionally used in the preparation of ANFO explosive compositions such as a lighter oil. An example of such a lighter oil is No. 2 fuel oil. The factors which influence whether a napthenic or paraffinic oil may be blended with a lighter oil include the temperature at which the ANFO explosive composition will be mixed and stored, the length of time during which the ANFO explosive composition will be stored prior to detonation and the viscosity of the napthenic or paraffinic oil which will be used in the oil blend. As the mixing and storage temperature decreases or, alternately, as the storage time prior to detonation decreases, an increased amount of a lighter oil may be used. Conversely, as the viscosity of the napthenic or paraffinic oil which will be used in the blend increases, an increased amount of a lighter oil may be incorporated in the blend. The oils may be blended in any ratio such that the viscosity of the oil blend provides the requisite degree of oil retention bearing in mind the storage time prior to detonation, the temperature at which the explosive will be mixed and stored and whether a paraffinic, napthenic or a blend of paraffinic and napthenic oils is used to prepare the oil blend. As is apparent from the forgoing, the oil which is used to prepare an ANFO explosive composition pursuant to this invention may be a napthenic oil, a paraffinic oil, a blend of napthenic and paraffinic oils or a conventional oil blended with any of the forgoing oils. By way of example, when the fuel oil and low adsorption nitrate particles are cold (lower than 5° C.) and the resultant explosive composition is loaded directly into boreholes which are at a temperature of 5° C., then up to about 50% of the naphthenic and paraffinic oil may be replaced. For example, in the above mentioned case, an ANFO explosive composition having a low degree of oil segregation for 2 weeks may be obtained by using, as a fuel source, a 50/50 mixture of No. 2 fuel oil and N-22 FRONTENAC oil.

The ANFO explosive compositions of this invention are substantially dry. Preferably, the ANFO explosive composition contains less than about 1 weight percent water and, more preferably less than about 0.5 weight percent water and, most preferably, less than about 0.2 weight percent water.

Various modifiers, densifiers and sensitizers which are conventionally used in the art may be incorporated into the ANFO explosive compositions of this invention. For example, energy increasers such as aluminium, magnesium, aluminium-magnesium alloys, ferrophosphorus, ferrosilicon, lead and its salts and trinitrotolune may be added. Suitable sensitizers include polystyrene beads, glass microspheres and other standard air entraining agents. Water blocking agents such as guar gum may be applied as a coating to the ammonium nitrate as is taught in U.S. Pat. No. 4,889,570.

The ANFO explosive compositions of the present invention may be made by any continuous, semi-continuous or batch process which is currently used to make ANFO explosive compositions. When the fuel source is a mixture of one or more oils, then these oils are preferably mixed prior to their addition to the ammonium nitrate.

While the ANFO explosive compositions of the instant invention may be used by themselves, these explosives may also be blended with emulsion explosives or water gel explosives as is known in the art.

The invention will be further understood by the following examples which are not to be construed as a limitation on the invention. Those skilled in the art will appreciate that other and further embodiments are obvious and within the spirit and scope of this invention from the teachings of the present examples taken with the accompanying specifications.

EXAMPLES 1-20

An oil settlement test was conducted using 940 grams of Esso AN special mini prills and 60 grams of Texaco Frontenac P-22 oil. The test was conducted according the procedure set out earlier in the disclosure. After one week, a 20 gram samples was taken from the top of the graduated cylinder and a 20 gram sample was taken from the bottom of the cylinder. The oil content of the oil was taken using an ether extraction analytical method (ASTM A-4224). The results are set out in Table 1. The experiment was repeated using other Frontenac oils namely, P-32, P-48, P-100, P-320, P-460, and N-10, N-22, N-68 and N-320. These results are also set out in Table 1.

TABLE 1

Examples 1-20

| | OIL TYPE | | | | | | | | | | | |
|---|---|---|---|---|---|---|---|---|---|---|---|---|
| | P-22 Ex. 1 | P-22 Ex. 2 | P-32 Ex. 3 | P-32 Ex. 4 | P-48 Ex. 5 | P-48 Ex. 6 | P-100 Ex. 7 | P-100 Ex. 8 | P-320 Ex. 9 | P-320 Ex. 10 | P-460 Ex. 11 | P-460 Ex. 12 |
| Viscosity, Cst. (ASTM D-445, 40° C.) | 19.8 | 19.8 | 33.1 | 33.1 | | | 99.4 | 99.4 | 305 | 305 | 466 | 466 |
| Oil Content - Top % | 3.8 | 3.8 | 4.3 | 4.3 | 5.0 | 5.0 | 5.6 | 5.6 | 5.3 | 5.5 | 5.6 | 5.6 |
| Oil Content - Bottom % | 11.1 | 11.8 | 4.9 | 5.1 | 5.0 | 4.9 | 5.2 | 5.8 | 5.6 | 5.6 | 5.1 | 5.1 |
| O. S. % | 7.3 | 8.0 | 0.6 | 0.8 | 0.0 | −0.1 | −0.4 | 0.2 | 0.3 | 0.1 | −0.5 | −0.5 |

| | OIL TYPE | | | | | | | |
|---|---|---|---|---|---|---|---|---|
| | N-10 Ex. 13 | N-10 Ex. 14 | N-22 Ex. 15 | N-22 Ex. 16 | N-68 Ex. 17 | N-68 Ex. 18 | N-320 Ex. 19 | N-320 Ex. 20 |
| Viscosity, Cst. (ASTM D-445, 40° C.) | 9.9 | 9.9 | 19.9 | 19.9 | 64.9 | 64.9 | 375 | 375 |
| Oil Content - | 4.0 | 4.1 | 4.3 | 4.3 | 5.4 | 5.4 | 5.9 | 5.9 |

TABLE 1-continued

| | Examples 1-20 | | | | | | | |
|---|---|---|---|---|---|---|---|---|
| Top % Oil Content - Bottom % | 8.5 | 8.1 | 6.1 | 5.9 | 5.4 | 5.3 | 5.9 | 6.0 |
| O. S. % | 4.5 | 4.0 | 1.8 | 1.6 | 0.0 | 0.1 | 0.0 | 0.1 |

EXAMPLES 21-36

The effect of temperature on oil separation was measured by repeating the procedure of Example 1 and varying the storage temperature. In these experiments, Frontenac P-22, P-32, P-100 and P-320 oils were utilized. The results are set out in Table 2.

TABLE 2

| Example | Oil Type | Temp. °C. | Viscosity, cps | O. S., % |
|---|---|---|---|---|
| 21 | P-22 | 5 | 80.5 | 0 |
| 22 | P-22 | 20 | 32.0 | 2.76 |
| 23 | P-22 | 30 | 25.0 | 3.30 |
| 24 | P-22 | 50 | 14.5 | 4.96 |
| 25 | P-32 | 5 | 170.5 | 0 |
| 26 | P-32 | 20 | 46.5 | 1.63 |
| 27 | P-32 | 30 | 32.5 | 2.41 |
| 28 | P-32 | 50 | 18.0 | 2.70 |
| 29 | P-100 | 5 | 885.0 | 0 |
| 30 | P-100 | 20 | 260.0 | 0 |
| 31 | P-100 | 30 | 221.0 | 0 |
| 32 | P-100 | 50 | 55.0 | 1.15 |
| 33 | P-320 | 5 | 12,880 | 0 |
| 34 | P-320 | 20 | 775 | 0 |
| 35 | P-320 | 30 | 385 | 0 |
| 36 | P-320 | 50 | 136 | 0 |

EXAMPLES 37-53

Experiments 21-36 were repeated utilizing Frontenac N-10 N-22, N-32 and N-68 oils. The results are set out in Table 3.

TABLE 3

| Example | Oil Type | Temp. °C. | Viscosity, cps | O. S., % |
|---|---|---|---|---|
| 37 | N-10 | 5 | 30.5 | 0 |
| 38 | N-10 | 20 | 18.5 | 2.43 |
| 39 | N-10 | 30 | 16.0 | 3.6 |
| 40 | N-10 | 50 | 10.5 | 4.03 |
| 41 | N-22 | 5 | 110.5 | 0 |
| 42 | N-22 | 20 | 37.5 | 0 |
| 43 | N-22 | 30 | 27.5 | 1.66 |
| 44 | N-22 | 50 | 15.5 | 8.68 |
| 45 | N-32 | 5 | 235.0 | 0 |
| 46 | N-32 | 20 | 63.0 | 0 |
| 47 | N-32 | 30 | 37.5 | 0.95 |
| 48 | N-32 | 50 | 21.0 | 4.95 |
| 50 | N-68 | 5 | 486.0 | 0 |
| 51 | N-68 | 20 | 128.0 | 0 |
| 52 | N-68 | 30 | 69.5 | 0 |
| 53 | N-68 | 50 | 30.0 | 0 |

EXAMPLES 54-58

Explosive compositions were prepared according to this invention using ESSO special mini-prills and Frontenac N-22 oil at a ratio of 94:6. The product was prepared and stored for a number of weeks at a temperature of 5° C. At the end of this period, the explosive was poured into a standard schedule 40 steel pipe, 76 cm in length. One end of the pipe was covered with a plastic cup prior to the explosive being poured into the pipe. The pipe was tapped as it was filled to allow the sample to settle and fill the volume of the pipe. A blasting cap plus TNT booster was placed into the explosive at the open end of the pipe. The pipe had three holes drilled into it in a linear fashion. Each hole was 13 cm apart from the preceding hole. A target wire was fed through each hole and placed within the explosive. The temperature of the explosive composition was recorded. The explosive was detonated and the velocity of the detonation was recorded using a calibrated oscilloscope. The velocity of detonation was measured between the first and second target wires and the second and third target wires. The results were set out in Table 4.

TABLE 4

| Experiment Number | Storage Time (weeks) | Pipe Diameter (mm) | Primer Weight (Kg) | Temperature (°C.) | First Velocity (m. p. s.) | Second Velocity (m. p. s.) |
|---|---|---|---|---|---|---|
| 54 | 6 | 50 | 0.227 | 6 | 3,968 | 2,442 |
| 55 | 4 | 102 | 0.45 | 4 | 4,233 | 4,379 |
| 56 | 6 | 102 | 0.45 | 6 | 4,535 | 4,703 |
| 57 | 4 | 152 | 0.45 | 4 | 4,096 | 4,379 |
| 58 | 6 | 152 | 0.45 | 6 | 4,792 | 5,079 |

We claim:

1. A storage stable explosive composition which may contain recognized additives for explosives consisting essentially of an explosive mixture of low adsorption ammonium nitrate particles and fuel oil, said fuel oil having viscosity sufficient to render the explosive composition detonatable and sufficient to render the composition loadable into a borehole.

2. The explosive composition as claimed in claim 1 wherein said explosive composition has an oil separation less than about 2%.

3. The explosive composition of claim 2 wherein the oil separation is less than about 1%.

4. The explosive composition of claim 1 wherein the viscosity of the fuel oil is less than about 400 cSt.

5. The explosive composition of claim 4 wherein the viscosity of the fuel oil is less than about 100 cSt.

6. The explosive composition of claim 1 wherein said fuel oil is one or more of paraffinic oil, naphthenic oil or paraffinic oil and naphthenic oil.

7. An explosive as claimed in claim 1 wherein said fuel oil is a blend of a lighter oil with one or more of paraffinic oil, napthenic oil or paraffinic oil and napthenic oil.

8. The explosive as claimed in claim 7 wherein said lighter oil is No. 2 fuel oil.

9. The explosive composition of claim 1 wherein said fuel oil substantially comprises a naphthenic oil having a viscosity greater than about 10 cSt as measured by ASTM D-445 at 40° C.

10. The explosive composition of claim 1 wherein said fuel oil substantially comprises a naphthenic oil having a viscosity greater than about 20 cSt as measured by ASTM D-445 at 40° C.

11. The explosive cOmposition of claim 1 wherein said fuel oil substantially comprises a naphthenic oil having a viscosity greater than about 25 cSt as measured by ASTM D-445 at 40° C.

12. The explosive of claim 1 wherein said fuel oil substantially comprises paraffinic oil having a viscosity greater than about 12.5 cSt as measured by ASTM D-445 at 40° C.

13. The explosive composition of claim 1 wherein said fuel oil substantially comprises a paraffinic oil having a viscosity greater than about 33 cSt as measured by ASTM D-445 at 40° C.

14. The explosive composition of claim 1 wherein said fuel oil substantially comprises a paraffinic oil having a viscosity greater than about 40 cSt as measured by ASTM D-445 at 40° C.

15. An explosive composition of claim 1 wherein the ammonium nitrate substantially comprises high density ammonium nitrate.

16. The explosive composition of claim 1, 6, 7 or 8 wherein said ammonium nitrate substantially comprises mini-prills.

17. The explosive composition of claim 15 wherein said ammonium nitrate has a density from about 0.85 to about 1.0 g/cc.

18. The explosive of claim 15 wherein the density of said ammonium nitrate is from about 0.90 to about 1.00 g/cc.

19. The explosive of claim 1 wherein said ammonium nitrate is coated with an anti-caking agent.

20. The explosive of claim 16 wherein said anti-caking agent is selected from the group consisting of magnesium stearate and a mixture of magnesium stearate and magnesium oxide.

21. The explosive composition of claim 1, 2, 4, 6, 7, 8, 15, 17 or 19 wherein said explosive composition is essentially free of tackifying agents.

22. The explosive composition of claim 1, 2, 4, 6, 7, 8, 15, 17 or 19 wherein said explosive further comprises one or more of additional oxidizing salts, sensitizers, densifiers and energy enhancers.

23. The explosive composition of claim 1, 2, 4, 6, 7, 8, 15, 17 or 19 wherein said explosive composition comprises less than about 1 wt. % water.

24. A storage stable explosive composition which may contain recognized additives for explosives consisting essentially of an explosive mixture of low adsorption ammonium nitrate particles and fuel oil, said fuel oil having viscosity sufficient to render the explosive composition detonatable and sufficient to render the composition loadable into a borehole said explosive composition being essentially free of tackifying agents.

25. The explosive composition of claim 24 wherein said ammonium nitrate substantially comprises mini prills.

26. The explosive composition of claim 25 wherein said mini prills have a density from about 0.85 to about 1.0 g/cc.

27. The explosive composition of claim 26 wherein said fuel oil is a mixture of fuel oils.

28. The explosive composition of claim 27 wherein said fuel oil is one or more of paraffinic oil, naphthenic oil or paraffinic oil and naphthenic oil.

29. The explosive composition as claimed in claim 25 wherein said fuel oil is a blend of a lighter oil with one or more of paraffinic oil, napthenic oil or paraffinic oil and napthenic oil.

30. The explosive as claimed in claim 29 wherein said lighter oil is No. 2 fuel oil.

31. The explosive composition of claim 28 wherein the oil separation is less than about 2%.

32. The explosive composition of claim 31 wherein said explosive further comprises one or more of additional oxidizing salts, sensitizers, densifiers and energy enhancers.

33. The explosive composition of claim 30 wherein the oil separation is less than about 2%.

34. The explosive composition of claim 33 wherein said explosive further comprises one or more of additional oxidizing salts, sensitizers, densifiers and energy enhancers.

35. The explosive composition of claim 23, 25 or 27 wherein said ammonium nitrate is coated with an anti-caking agent.

36. The explosive composition of claim 25, 31 or 33 wherein said explosive composition comprises less than about 1 wt. % water.

37. The explosive composition of claim 25, 31 or 33 wherein said explosive composition is blended with an emulsion explosive composition.

38. The explosive composition of claim 25, 31 or 33 wherein said explosive composition is blended with a water gel explosive composition.

39. A method for producing a storage stable explosive composition which may contain recognized additives for explosives consisting essentially of an explosive mixture of low absorbtion ammonium nitrate particles and fuel oil comprising the steps of:

(a) selecting a fuel oil having viscosity sufficient to render the storage stable explosive composition detonatable and sufficient to render the storage stable explosive composition loadable into a borehole;

(b) combining said fuel oil with a sufficient amount of low absorbtion ammonium nitrate particles to render the explosive composition essentially oxygen-balanced; and, (c) mixing said ammonium nitrate with said fuel oil.

40. The method as claimed in claim 39 when said storage stable explosive composition has an oil separation less than about 2%.

41. The method as claimed in claim 40 wherein the oil separation is less than about 1%.

42. The method as claimed in claim 39 wherein the viscosity of the fuel oil is less than about 400 cSt.

43. The method as claimed in claim 39 wherein the viscosity of the fuel oil is less than about 100 cSt.

44. The method of claim 39 wherein said fuel oil is one or more of paraffinic oil, naphthenic oil or paraffinic oil and naphthenic oil.

45. The method as claimed in claim 39 wherein said fuel oil is a blend of a lighter oil with one or more of paraffinic oil, napthenic oil or paraffinic oil and napthenic oil.

46. The method as claimed in claim 45 wherein said lighter oil is No. 2 fuel oil.

47. The method of claim 39 wherein the ammonium nitrate substantially comprises high density ammonium nitrate.

48. The method of claim 39, 44, 45 or 46 wherein said ammonium nitrate substantially comprises mini-prills.

49. The method of claim 47 wherein said ammonium nitrate has a density from about 0.85 to about 1.0 g/cc.

50. The method of claim 47 wherein the density of said ammonium nitrate is from about 0.90 to about 1.00 g/cc.

51. The method of claim 39 wherein said ammonium nitrate is coated with an anti-caking agent.

52. The method of claim 51 wherein said anti-caking agent is selected from the group consisting of magnesium stearate and a mixture of magnesium stearate and magnesium oxide.

53. The method of claim 39, 40, 42, 44, 45, 46, 47, 49 or 51 wherein said explosive composition is essentially free of tackifying agents.

54. The method of claim 39, 40, 42, 44, 45, 46, 47, 49 or 51 wherein said explosive further comprises one or more of additional oxidizing salts, sensitizers, densifiers and energy enhancers.

55. The method of claim 39, 40, 42, 44, 45, 46, 47, 49 or 51 wherein said explosive composition comprises less than about 1 wt. % water.

56. The method of claim 39, 40, 42, 44, 45, 46, 47, 49 or 51 wherein the product of step (c) of claim 39 is loaded into a borehole.

* * * * *